United States Patent [19]

Jackson

[11] Patent Number: 4,767,371

[45] Date of Patent: Aug. 30, 1988

[54] INFLATABLE BUOYANCY OILSKIN JACKET

[76] Inventor: Michael A. Jackson, 27670 Lofall Ct., Poulsbo, Wash. 98370

[21] Appl. No.: 90,390

[22] Filed: Aug. 27, 1987

Related U.S. Application Data

[63] Continuation of Ser. No. 915,950, Oct. 3, 1986, abandoned, which is a continuation of Ser. No. 638,036, Aug. 6, 1984, abandoned.

[51] Int. Cl.[4] ..... B63C 9/16

[52] U.S. Cl. ..... 441/94; 441/93; 441/102; 441/106; 441/116

[58] Field of Search ..... 441/92, 94, 96, 102, 441/107, 116, 93, 106, 108, 118

[56] References Cited

U.S. PATENT DOCUMENTS

| | | | |
|---|---|---|---|
| 2,774,979 | 12/1956 | Moran | 441/96 |
| 2,823,396 | 2/1958 | Erickson | 441/94 |
| 2,886,835 | 5/1959 | Moran | 441/94 |
| 3,266,069 | 8/1966 | O'Link | 441/107 |
| 3,266,070 | 8/1966 | O'Link | 441/107 |
| 3,354,480 | 11/1967 | Harding | 441/94 |
| 3,441,963 | 5/1969 | Steinthal | 441/107 |
| 3,449,777 | 6/1969 | Hattori | 441/94 |
| 3,497,889 | 3/1970 | Mellin, Jr. | 441/118 |
| 3,771,183 | 11/1973 | Moran | 441/118 |
| 4,416,641 | 11/1983 | Spinosa et al. | 441/107 |
| 4,560,356 | 12/1985 | Burr | 441/94 |

FOREIGN PATENT DOCUMENTS

| | | | |
|---|---|---|---|
| 103929 | 6/1966 | Denmark | 441/107 |

*Primary Examiner*—Sherman D. Basinger

*Assistant Examiner*—Thomas J. Brahan

*Attorney, Agent, or Firm*—Roy E. Mattern, Jr.

[57] ABSTRACT

A garment to be worn conveniently and comfortably over the upper body of a seagoing person to gain protection from rain, wind, and/or cold, which includes an interior deflated fluid tight enclosure, i.e. a bladder, to be very quickly inflated inside the garment in a time of emergency. The deflated fluid tight enclosure covers at least the interior upper back portion of this garment and also covers at least the interior of the right and left chest portions of this garment. An inflating subassembly is operatively secured between the deflated fluid tight enclosure and to either the right or left chest portion of this garment. This inflating subassembly has an alternatively usable mouth and lung inflatable valved air intake-discharge communicating with the deflated fluid tight enclosure, and an alternatively usable filled compressed fluid valved cylinder discharge also communicating with the deflated fluid tight enclosure and having a coilable pullable lanyard. Then a pocket like subassembly is removably secured, by using loop and hook fasteners on the exterior of the garment at either the right or left chest portion and is non removably secured to the coilable pullable lanyard. This pocket like assembly fully covers and protects the inflating subassembly, until an emergency, when the seagoing person intentionally, readily, and quickly, pulls the pocket like assembly away from the garment, causing the pulling of the lanyard to activate the valve on the compressed fluid valved cylinder. The fluid tight enclosure is then quickly inflated, creating the buoyancy needed by this seagoing person.

2 Claims, 3 Drawing Sheets

FIG. 1
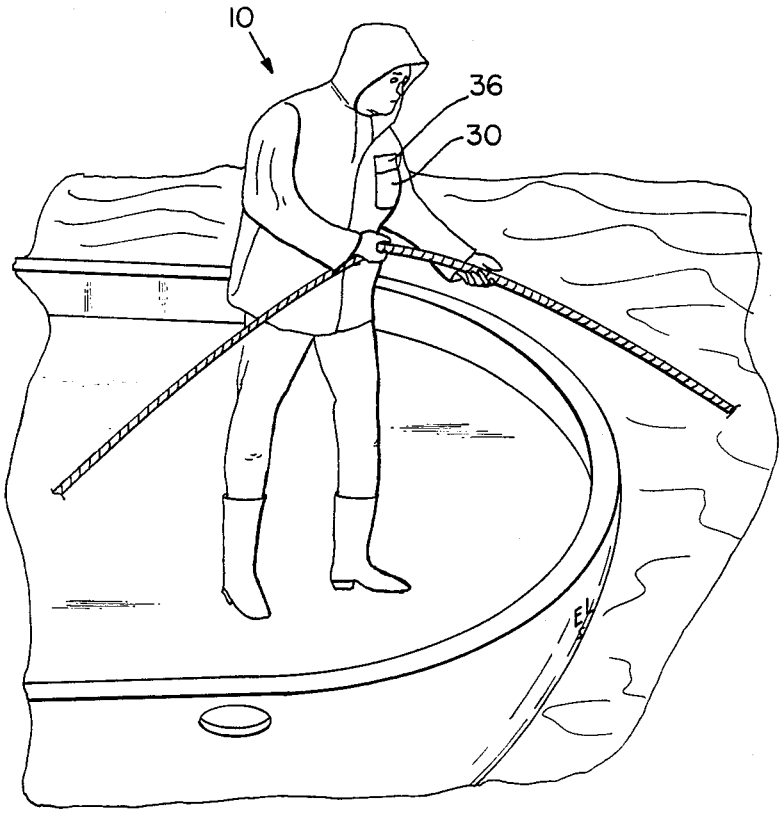
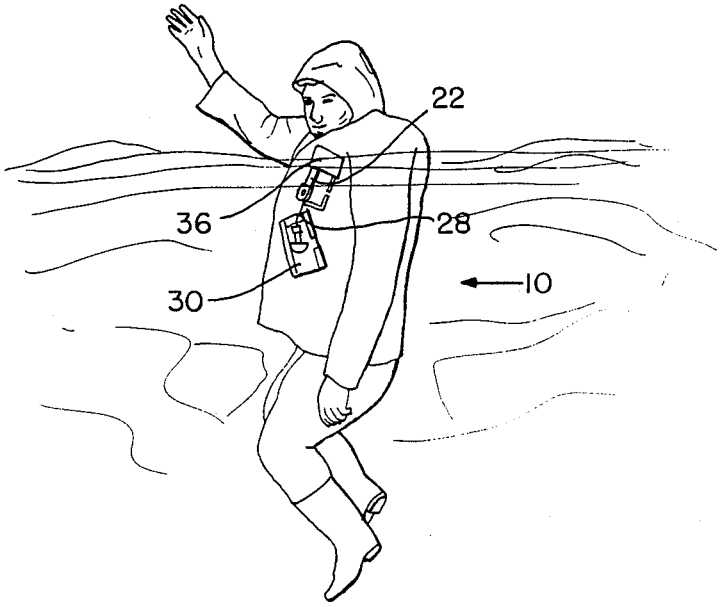
FIG. 2

INFLATABLE BUOYANCY OILSKIN JACKET

This application is a continuation of application Ser. No. 915,950, filed 10/3/86, now abandoned, which in turn was a continuation of Ser. No. 638,036, filed 8/6/84, now abandoned.

BACKGROUND OF THE INVENTION

1. Field of Invention

The invention pertains to the art of inflatables, and more particularly to the art of manufacture of inflatable life preservers, especially those adapted to be integrated in a vest or jacket like protective garment. The invention thus falls within the field of inflatable life preservers, which are an integral part of a garment designed for a use other than lifesaving. The invention, further, is so designed as to be adaptable for military and civilian use, installed in an oilskin jacket.

2. Prior Art

Most inflatable personal flotation devices in use today are a separate unit requiring extra time and a conscious awareness of a dangerous situation for use. The inflatable personal flotation devices that currently are integrated into garments are primarily designed for use by the military, intended for specific applications, or for the yachtsman who occasionally is exposed to a potentially dangerous situation. In that regard many professional mariners, especially commercial fishermen, are frequently reluctant to be seen, or to be bothered, wearing a personal flotation device even when conditions are dangerous.

Typical of the prior art as described above are the following patents:

J. Harding, et al.: 3,345,657
H. J. Moran, et al.: 3,771,183
C. E. Erickson 2,823,396
George Bailhe: 2,607,934 in 1952
K. A. L. Nojd: Dansk 103929 in 1966
A. J. Steinthal: 3,441,963 in 1969
Messrs. Spinosa and Knoll: 4,416,641 in 1983
Kelsey Burr: 4,560,356 in 1985

It has been important, in inflatable personal flotation devices as those shown in the prior art patents, to assure that the flotation compartment design be capable of use with various types of military, civilian, and sportsmen garments and that the flotation compartment offer ample buoyancy so as to keep the head of the wearer out of the water. The prior art patent of H. J. Moran even offers an additional flotation compartment as a safety factor; that is, if one of the two flotation compartments is damaged the other will adequately support the wearer. The prior art inflatable personal flotation devices have unquestionably been of great benefit to those who had need and were equipped with one of these devices.

However, certain deficiencies must be noted in the prior art. In the prior art inflatable personal flotation devices cited above, these inflatables are designed to be worn separately and/or incorporated into a specific type garment. It is not reasonable to expect a professional mariner, such as a commercial fisherman to wear a military flight suit or a sportsman vest while at sea. It is also impossible for an inflatable personal flotation device to save a life if it is not on the person or available to them at their critical time of need. The majority of deaths caused by man overboard accidents are not the result of a predictable situation or an inherently dangerous one; most often it is the result of a freak accident in which the unfortunate victim is pitched into the sea. According to the U.S. Coast Guard a full 75 per cent of these victims might have lived had they been wearing their personal flotation devices. It must also be noted that the large majority of mariners are not in the military and therefore do not have access to those inflatable life preservers of the prior art should they have the inclination to wear them. Although many commercially available life preservation devices have been approved by the U.S. Coast Guard, for use by the general public, for the most part these devices remain in a locker somewhere ready for use should the occasion arise. There are other products currently available that perform this function far better than an inflatable personal flotation device; for example the survival suit is designed to not only keep a victim afloat but also to protect against exposure and hypothermia. If a victim were aware of impending danger, i.e. the boat is sinking, or the weather is more severe than the boat is capable of withstanding, the victim would no doubt use the survival suit rather than the currently available personal flotation devices, both of which are probably in the same locker. It is therefore of primary importance that a personal flotation device become standard equipment of those who work at sea. This is best accomplished by integration of the inflatable flotation compartment with a garment that is already standard equipment for those who work at sea.

Mr. Bailhe in 1952 in his U.S. Pat. No. 2,607,934 disclosed his safety garment of a special design, inclusive of a high neck portion, where an inflating valve was secured. Then in 1966 in Dansk Pat. No. 103929, Mr. Nojd illustrated and described his garment of a somewhat special design and he provided alternatively used inflation subassemblies having exposed portions thereof for ready access. In 1969, Mr. Steinthal in U.S. Pat. No. 3,441,963 disclosed his inflatable sailing jacket of a somewhat special design and his alternatively used inflation subassemblies, which were exposed in part. Thereafter in 1983, in U.S. Pat. No. 4,416,641, Messrs. Spinosa and Knoll illustrated and described their anti-exposure jacket of a very special design and in one embodiment the alternatively used inflation subassemblies had exposed portions thereof for ready access, and in another embodiment, they were covered by an outer garment portion. More recently in 1985 in U.S. Pat. No. 4,560,356, Kelsey Burr illustrated and described his several embodiments of his personal flotation devices. In one worn on a belt, an inflatable partial lifesaving ring was packed into a rectangular container. Access to the container was undertaken by pulling on a side thereof initially secured by loop and hook fasteners. Moreover the pull on this side also pulled an attached lanyard, which caused the release of compressed fluid used in inflating the partial lifesaving ring.

The present invention is intended to correct these deficiencies in the prior art, by integrating the inflatable flotation chamber with the most common and most utilized piece of personal gear used by all those who venture upon the sea, most especially commercial fishermen and others who make their living upon the sea. In so doing, this integration of the inflatable flotation chamber must not change the feel and comfort of the type of garment previously worn by the seagoing person. Moreover, the alternatively used inflation subassemblies, when not to be used, must be protectively covered, keeping them from being entangled during the working times of the seagoing person. Yet when she or he, in an emergency, needs to activate either of these inflation subassemblies, all she or he must be required to do is take either a right or left hand and quickly expose them and activate them.

SUMMARY OF THE INVENTION

The subject invention is a garment to be worn conveniently and comfortably over the upper body of a seagoing person to gain protection from rain, wind, and/or cold, which includes an interior deflated fluid tight enclosure to be very quickly inflated inside the garment in a time of emergency, by pulling away a chest pocket subassembly, which in turn directly results in inflating the fluid tight enclosure. The garment, when an oilskin foul weather jacket, is normally worn in the deflated and fully covered mode by the fishermen as they work on board the ships and may be inflated manually or in an alternative embodiment, automatically should the fisherman be swept overboard for example. The overall garment comprises a U-shaped continuous inflatable chamber which is secured to the inside of any oilskin foulweather jacket. Inflating means include an inflator assembly as well as an auxiliary oral inflator tube. The U-shaped chamber is adapted such that a collar section is secured to the upper back portion of the interior of the oilskin jacket while body lobes extend down each side of the jacket to lie upon the chest of the wearer. The inflator assembly has an attached lanyard which is in turn secured to a pocket flap cover removably mounted on the front of the oilskin jacket. Activation of the inflator assembly is accomplished by removing and then pulling down on the pocket flap cover. The cover is secured to a lanyard which is secured at its opposite end to a lever. A $CO_2$ cartridge, secured into an extending portion of the chamber, is then activated to inflate the chamber by being punctured by a spring activated piercing pin connected to the lever.

BRIEF DESCRIPTION OF THE DRAWINGS

FIG. 1 is an environmental view of the inflatable buoyancy oilskin jacket worn by a fisherman in the deflated mode.

FIG. 2 is an environmental view showing the jacket in the inflated mode wherein the fisherman has manually activated the inflator assembly by removing and then pulling on the pocket flap cover, both also shown.

DETAILED DESCRIPTION OF THE PREFERRED EMBODIMENTS

Referring now to the various drawings, it will be noted that the preferred embodiment of the inflatable buoyancy jacket 10 or jacket 10 broadly comprises: a standard oilskin, a U-shaped continuous inflatable flotation chamber 12 and an inflator assembly 20.

As shown in FIG. 1 of the drawings, the inflatable buoyancy jacket 10 is to be worn primarily by fishermen in the deflated mode while working on board their fishing boats. The inflatable buoyancy jacket 10 may be worn in combination with overalls or waterproof pants together to serve as foulweather gear and protect the fisherman against rain as well as the waves and water which spills from the fishing nets as they are hauled in. The oilskin is a standard item and may serve as the basic garment for which the inflatable buoyancy jacket 10 invention is made.

Figure 3:
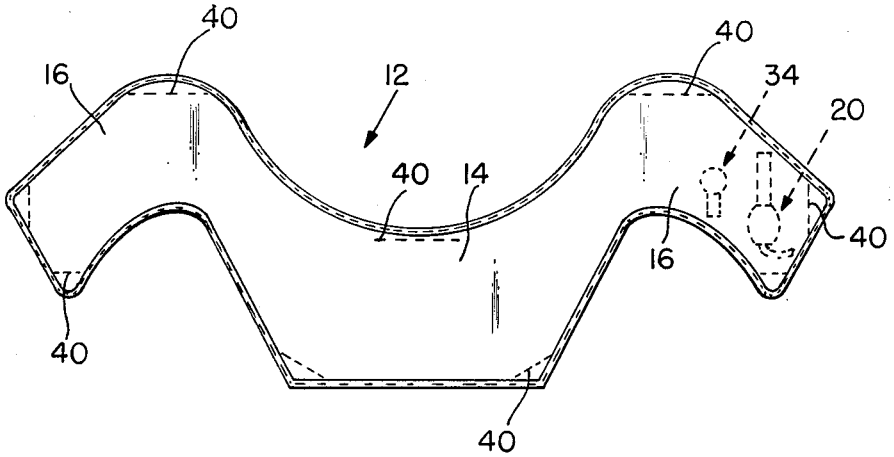
FIG. 3 is an enlarged view of the U-shaped continuous inflatable chamber.
Figure 4:
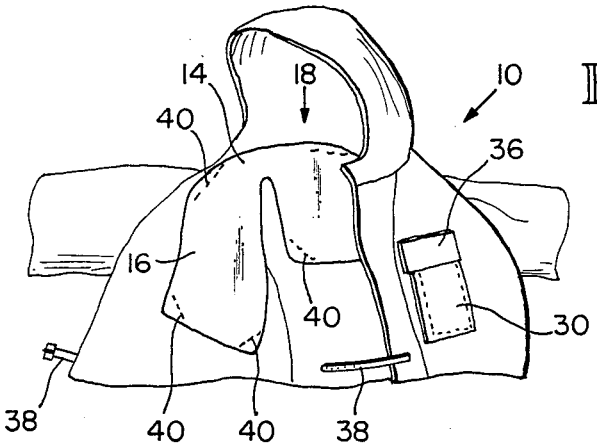
FIG. 4 is a perspective view of the inflatable buoyancy oilskin jacket showing the pocket flap cover in place and the chamber in the deflated mode.
Figure 5:
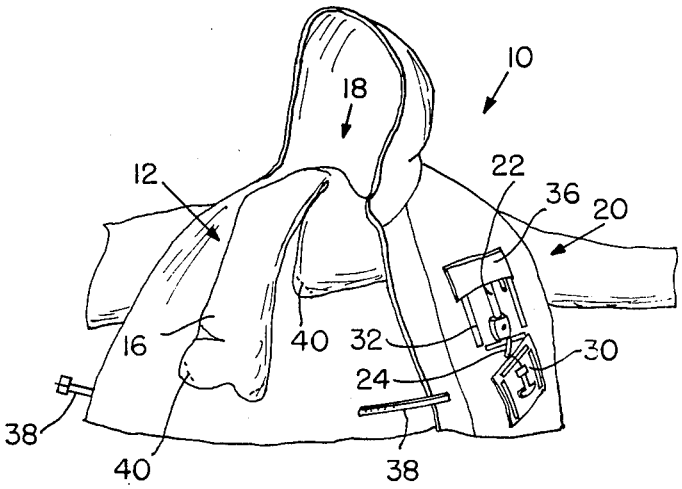
FIG. 5 is a perspective view of the jacket with the chamber inflated, the flap cover having been removed and the inflator assembly activated.

The U-shaped continuous inflatable chamber 12 or chamber 12 further comprises a collar section 14 and two body lobes 16. The chamber 12 is secured at its collar section 14 along the upper interior of the jacket 10 at the upper back portion 18 as shown in FIG. 4. The body lobes 16 continuously communicate with the collar section 14 to form a single cavity within the chamber 12. The body lobes 16 are secured to the interior of the jacket 10 along each side as shown in FIGS. 4 and 5. Points of connection spaced along the perimeter of the chamber 12 are referred to as 40, as illustrated in FIGS. 3, 4 and 5. Such attachments may be made with stitches, snaps, rivets or any other method which will firmly locate and secure the chamber 12 in the jacket 10. While the primary embodiment of the invention incorporates a permanently secured chamber such as with stitches, other embodiments may include a detachable or interchangeable chamber which may be sold as a separate accessory and installed in the fisherman's previously purchased jacket.

The chamber 12 is preferably constructed of a lightweight polyurethane coated nylon, neoprene coated nylon, rubber, vinyl or other lightweight gas retaining material.

The inflator assembly 20 is secured to the exterior of the jacket 10 to extend into the chamber 12 and permit the transmission of air to fill the chamber 12.

Figure 7:
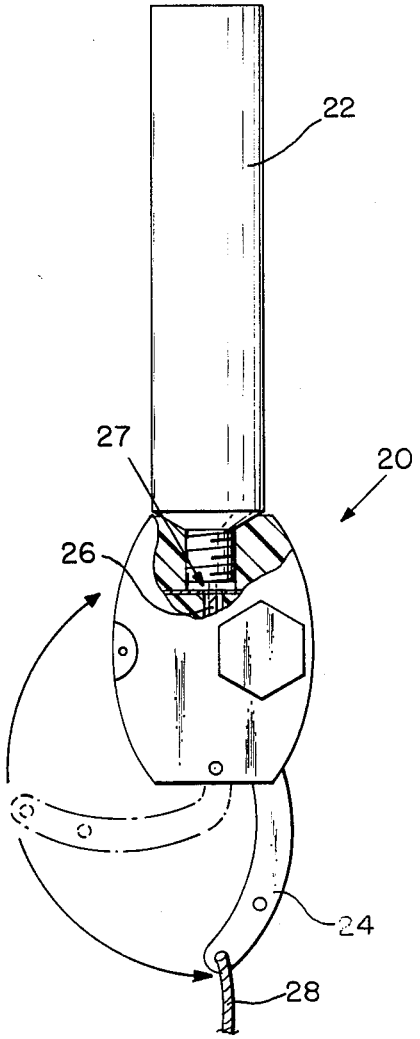
FIG. 7 is an enlarged view of the inflator assembly with a portion cut away to show the spring activated piercing pin.

The inflator assembly 20 utilizes a sealed $CO_2$ cartridge 22. Details of the inflator assembly 20 are limited for the sake of simplicity since its components are often used on life preservers and the like. The assembly further includes a lever 24 which is connected at one end to a spring actuated piercing pin 26. The lever has a lanyard 28 attached to its opposite end as shown in FIG. 7. The opposite end of the lanyard 28 is secured to the interior of the pocket flap cover 30. When the pocket flap cover 30 is pulled away from its Velcro mounting strip 32 and then pulled downwardly, the lever 24 is consequently pulled downwardly, thereby activating the piercing pin 26 which then punctures the $CO_2$ cartridge 22 causing inflation of the chamber 12 upon demand. The sealed $CO_2$ cartridge 22 is removably mounted into the threaded end of the transmission portion 27 of the inflator assembly 20.

The primary embodiment of the invention requires the fisherman or other wearer to manually remove the pocket flap cover 30 to activate the inflator assembly 20; an alternative embodiment would provide for automatic inflation when the inflator assembly 20 was submerged in water. In such embodiment, the spring activated piercing pin 26 could be held in an inactive position by a salt grain or tablet of other dissolvable material which would activate the piercing pin 26 upon being dissolved in the water. Other possible means could be used for automatic inflation as well.

Figure 6:
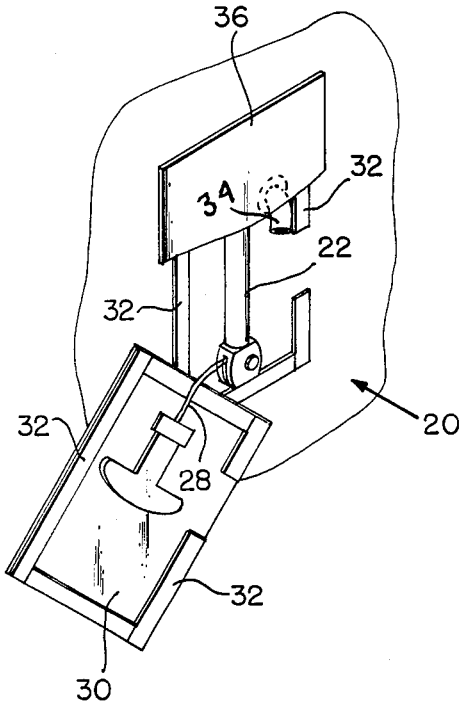
FIG. 6 is an enlarged view of the inflator assembly secured to the pocket flap cover by the lanyard.

An auxiliary inflating means is provided by the oral inflator tube 34 as shown in FIG. 6. The oral inflator tube 34 may be used if the inflator assembly 20 fails to operate. The oral inflator tube 34 will normally be screwed in place to seat against the surface of the jacket 10 to serve as a valve. Deflation of the chamber 12 may then be accomplished by unscrewing the tube 34 such as is done with other lifesaving vests.

A pocket flap cover 30 is removably secured to the front of the oilskin jacket 10 preferably at breast pocket location. The pocket flap cover 30 or cover 30 is preferably secured to mounting strips of Velcro 32 which have been attached to the front of the oilskin jacket 10. Snaps or other means may be used to secure the cover 30 in place, to serve as protection for the inflator assembly 20 and oral inflator tube 34 which project from the chamber 12 through the jacket 10 to be accessible beneath the cover 30. The cover 30 also serves to prevent damage or interference to the inflating means from exterior sources, yet allows for manual activation with a gloved groping hand. The pocket flap cover 30 is additionally secured to the jacket 10 by a top flap 36 which is stitched or otherwise permanently affixed to the oilskin jacket and across the top and down the sides of the top flap 36 as illustrated in FIG. 6.

An additional feature of the inflatable buoyancy jacket 10 is a safety buckle 38 which is secured to the bottom of the coat and may be wrapped around the midsection of the wearer to prevent the jacket 10 from coming off in case it is unsnapped while the wearer is in the water for example.

I claim:

1. A garment to be worn conveniently and comfortably over the upper body of a seagoing person to gain protection from rain, wind, and/or cold, including an interior deflated fluid tight enclosure to be very quickly inflated inside the said garment in a time of emergency, comprising:

(a) the said garment to cover at least the back and right and left chest portions of a seagoing person;

(b) an upper back portion of this said garment having respective interior fastening means to secure portions of the said interior deflated fluid tight enclosure.

(c) right and left chest portions of this said garment having respective interior fastening means to secure portions of the said interior deflated fluid tight enclosure;

(d) the said interior deflated fluid tight enclosure covering at least the interior upper back portion of this said garment and secured by the said respective interior fastening means, and also covering the said respective interiors of the right and left chest portions of this said garment and secured by the said respective interior fastening means;

(e) an inflating subassembly for operating secure attachment between the said interior deflated fluid tight enclosure and secure attachment to either the said right or left chest portion of this said garment, on the exterior thereof, having the alternatively used mouth and lung inflatable valved air intake-discharge, communicating with the said interior deflated fluid tight enclosure, and an alternatively used filled compressed fluid valved cylinder discharge, also communicating with the said interior deflated fluid tight enclosure, and a coilable pullable means having one end secured to the said filled compressed valve fluid cylinder and having a free end, which when pulled, causes fluid to leave the said filled compressed valved fluid cylinder and to enter the then inflating said interior fluid tight enclosure; and (f) a pocket flap cover having loop and hook fasteners, arranged across the bottom and along the side edges of the said pocket flap cover, and removably secured to the said garment, by using the complementary loop and hook fasteners, secured to the said garment on the exterior thereof, at either the said right or left chest portion, thereby forming an open top chest pocket, having an upper edge, and having in addition a top overlay tab secured to said garment on the exterior thereof, using fastening means along the top and side edges, forming an open bottom of the said top overlay tab, to receive and to protect the said upper edge of the said pocket flap cover, allowing the seagoing person's hand to reach in and grasp the said upper edge of the said pocket flap cover, and the said pocket flap cover is non removably secured to the otherwise free end of the said coilable pullable means to keep this said coilable pullable means fully and protectively concealed, when there is no need to inflate the said interior deflated fluid tight enclosure during normal crew activities about a vessel, and yet when an emergency occurs, to be readily and quickly pulled away by a seagoing person, using either hand, which pulling on the said upper edge, in turn causes the uncoiling and extending of the said pullable means, to thereby activate the said compressed valve fluid cylinder to inflate the previously said interior deflated fluid tight enclosure, and if that fails, to expose the mouth and lung inflatable valved air intake-discharge for its alternate use, to inflate the previously said interior deflated fluid tight enclosure.

2. An inflatable buoyancy garment intended to be worn on an upper body of the wearer as a jacket, wherein a U-shaped air chamber is securely attached to the inside of said garment; and comprising, in addition:

(a) an inflator assembly securely positioned to the outside of the said garment at a breast pocket location thereof, and depending from the said U-shaped air chamber, and communicating with the inside of the said U-shaped chamber, having a pressurized gas filled cylinder to discharge gas into the said U-shaped air chamber, and a lever arm, having in turn one piercing end to pierce the said gas filled cylinder, and another end to receive a lanyard, and a coilable and extendable said lanyard having one end secured to the said lever arm and another end for subsequent securement, and having an oral inflation tube and valve thereof communicating with the inside of the said U-shaped air chamber for alternate use in inflating the U-shaped air chamber; and (b) an exterior removable pocket flap cover, adapted and located to be easily removed with either hand of the wearer, removably secured to the said garment, having portions of fasteners such as snaps or hook and loop fabric, to complementary interfit with snaps or hook and loop fabric secured to the said garment, wherein this said exterior removable pocket flap cover is so secured to said garment along the bottom and side edges forming an open top chest pocket on the said garment, having an upper edge and having a top flap secured to the said garment along the top and side edges forming an open bottom to receive and to protect the said upper edge, while allowing the seagoing person's hand to reach in and grasp the said upper edge of the said exterior removable pocket flap cover, which covers the said inflator assembly, and this said exterior removable pocket flap cover is secured to the other end of the said coilable and extendable lanyard, whereby upon the intentional pulling away of this said exterior removable pocket flap cover by the wearer using his or her left or right hand, the said lanyard is uncoiled, extended and pulled to move the said lever arm, to in turn pierce the said gas filled cylinder, to in turn inflate the said U-shaped chamber, and if that fails, to expose the said oral inflation tube and valve thereof for alternate use in inflating the said U-shaped air chamber.

* * * * *